US011828130B2

(12) United States Patent
Warneke

(10) Patent No.: US 11,828,130 B2
(45) Date of Patent: Nov. 28, 2023

(54) RELEASE MECHANISM FOR MECHANICALLY LOCKED WIPER PLUG SYSTEM

(71) Applicant: Dril-Quip, Inc., Houston, TX (US)

(72) Inventor: Jacob S. Warneke, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 243 days.

(21) Appl. No.: 17/414,258

(22) PCT Filed: Dec. 17, 2019

(86) PCT No.: PCT/US2019/066707
§ 371 (c)(1),
(2) Date: Jun. 15, 2021

(87) PCT Pub. No.: WO2020/131782
PCT Pub. Date: Jun. 25, 2020

(65) Prior Publication Data

US 2022/0049570 A1 Feb. 17, 2022

Related U.S. Application Data

(60) Provisional application No. 62/811,679, filed on Feb. 28, 2019, provisional application No. 62/783,732, filed on Dec. 21, 2018.

(51) Int. Cl.
*E21B 33/12* (2006.01)
*E21B 23/03* (2006.01)

(52) U.S. Cl.
CPC ..... *E21B 33/12* (2013.01); *E21B 23/03* (2013.01)

(58) Field of Classification Search
CPC ..... E21B 33/12; E21B 23/03; E21B 33/16; E21B 23/06
See application file for complete search history.

(56) References Cited

U.S. PATENT DOCUMENTS 3,915,226 A 10/1975 Savage
4,008,759 A * 2/1977 Blackwell ..... E21B 23/06 166/120
4,576,230 A * 3/1986 Tapp ..... E21B 33/1292 166/138

(Continued)

OTHER PUBLICATIONS

International Search Report and Written Opinion issued in related PCT Application No. PCT/US2019/066707 dated Apr. 21, 2020, 12 pages.

(Continued)

*Primary Examiner* — Steven A Macdonald
(74) *Attorney, Agent, or Firm* — Baker Botts L.L.P.

(57) ABSTRACT

A release mechanism for a mechanically locked wiper plug system is provided. The release mechanism may utilize a shifting sleeve to rotate or pivot a release.sub, thus: disengaging a load shoulder and releasing the plug system, in some embodiments, the plug system may be mechanically locked to a running tool via corresponding slotted load shoulders in the running tool and on a release sub. The release sub may be connected: to an actuation sleeve via shear screws. Furthermore, the actuation sleeve may contain a guide consisting of one or more helical slotted guides which interact with the release sub shear screws.

16 Claims, 8 Drawing Sheets

(56) References Cited

U.S. PATENT DOCUMENTS

| | | | | | |
|---|---|---|---|---|---|
| 4,638,860 | A * | 1/1987 | Magee, Jr. | E21B 33/12 | 166/126 |
| 4,966,236 | A * | 10/1990 | Braddick | E21B 43/10 | 166/291 |
| 5,018,579 | A * | 5/1991 | Braddick | E21B 33/165 | 166/291 |
| 5,020,597 | A * | 6/1991 | Braddick | E21B 33/16 | 166/291 |
| 5,360,069 | A * | 11/1994 | Schmuck | E21B 23/00 | 166/383 |
| 6,527,057 | B2 | 3/2003 | Fraser, III et al. | | |
| 9,200,499 | B2 | 12/2015 | Hall et al. | | |
| 9,297,231 | B2 | 3/2016 | Smith | | |
| 10,760,363 | B2 * | 9/2020 | Tom | E21B 23/01 | |
| 2008/0251253 | A1 | 10/2008 | Lumbye | | |
| 2009/0188664 | A1 | 7/2009 | Smith, Jr. et al. | | |

OTHER PUBLICATIONS

International Preliminary Report on Patentability issued in related PCT Application No. PCT/US2019/066707 dated Jul. 1, 2021, 9 pages.

* cited by examiner

RELEASE MECHANISM FOR MECHANICALLY LOCKED WIPER PLUG SYSTEM

CROSS-REFERENCE TO RELATED APPLICATIONS

The present application is a U.S. National Stage Application of International Application No. PCT/US2019/066707 filed Dec. 17, 2019, which claims priority to U.S. Provisional Application Ser. No. 62/783,732 filed on Dec. 21, 2018 and U.S. Provisional Application Ser. No. 62/811,679 filed on Feb. 28, 2019 all of which are incorporated herein by reference in their entirety for all purposes.

TECHNICAL FIELD

The present disclosure relates generally to release systems for mechanically locked downhole tools and, more particularly, to release mechanisms for mechanically locked wiper plug systems.

BACKGROUND

When drilling a well, a borehole is drilled typically from the earth's surface to a selected depth. In many applications, the wellbore is lined with a string of casing to add support to the wellbore so that it does not collapse. For deep wellbores, the wellbore is often drilled in sections with successively deeper sections having smaller diameters. A drill bit is passed through the initial cased borehole and then is used to drill a smaller diameter borehole to an even greater depth. A smaller diameter casing may then be suspended and cemented in place within the new borehole. Typically, this is repeated until a plurality of concentric casings are suspended and cemented within the well to a depth which causes the well to extend through one or more hydrocarbon producing formations. Rather than suspending a concentric easing from the bottom of the borehole to the surface, a liner is often suspended adjacent to the lower end of the previously suspended casing, or from a previously suspended and cemented liner, so as to extend the liner from the previously set casing, or liner to the bottom of the new borehole. A liner is defined as casing that is not run to the surface.

Once the liner is placed in the borehole, a gap exists between the liner and the borehole, called an annulus, which must be filled with cement in order to secure the liner in place. To accomplish this, cement is pumped down the bore of the liner, thus forming a travelling cement column. After reaching the bottom opening of the liner, the cement column is continually pumped so that it exits the liner, spreads outward, and travels up the annulus.

During the cementing operation, after the cement is pumped into the borehole, the cement column is pumped down the borehole by way of a pressurized drilling fluid. Without the use of any separation devices, the cement column would mix with the pressurized drilling fluid above and with fluid already in the borehole below, which would dilute or otherwise compromise the integrity of the cement. To prevent this, liner wiper plugs are used to separate the cement column from the fluids above and below the column and to clean the inside of the casing liner of any drilling fluid or other downhole fluid. Cementing operations may use a single plug, placed above or below the column, or two plugs with one placed on either end of the cement column. The wiper plug has flexible wings that wipe the inside circumference of the liner and create a seal between the cement on one side and the fluid on the other.

Once the cement column is pumped into the annulus, a liner wiper plug can be released from the running tool to which it is attached. There are many types of release mechanisms for liner wiper plug systems. Improvements to existing liner wiper plug release systems are desired.

BRIEF DESCRIPTION OF THE DRAWINGS

For a more complete understanding of the present disclosure and its features and advantages, reference is now made to the following description, taken in core unction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The following disclosure relates to a pivoting release mechanism that utilizes utilize a shifting sleeve to rotate or pivot a release sub, thus disengaging a load shoulder and releasing the plug system. In some embodiments, the plug system may be mechanically locked to a running tool via corresponding slotted load shoulders in the running tool and on a release sub. The release sub may be connected to an actuation sleeve via shear screws or other temporary securing mechanism. Furthermore, the actuation sleeve may contain a guide consisting of helical slots which interact with the release sub shear screws.

The following disclosure relates also to a retracting, collected release sub where the collets are, initially, propped up by a raised surface on the outer diameter surface of an actuation sleeve. An adjacent groove, or a lowered surface, on the actuation sleeves allows the collets to contract in the event that the actuation sleeve shifts.

In some embodiments, when releasing the wiper plug system, a drill pipe cementing dart may land in the actuating sleeve, thus shifting the sleeve downhole. In turn, the axial motion of the actuation sleeve may force the guide pins to rotate within the helical guides, thereby pivoting the release sub. At the completion of the pivot, the load shoulders of the release sub may be aligned with the slots in the running tool load shoulder, allowing the release sub to move downhole, thereby releasing the plug system.

As a person of ordinary skill in the art would appreciate, the disclosed release system can be adapted easily to be used with any downhole running tool. In some embodiments, the downhole tool that uses the disclosed release system is a liner wiper plug. Other downhole tools, used in other embodiments, include but are not limited to casing cement plugs, liner hanger running tools, squeeze tools, and so forth.

Figure 1:
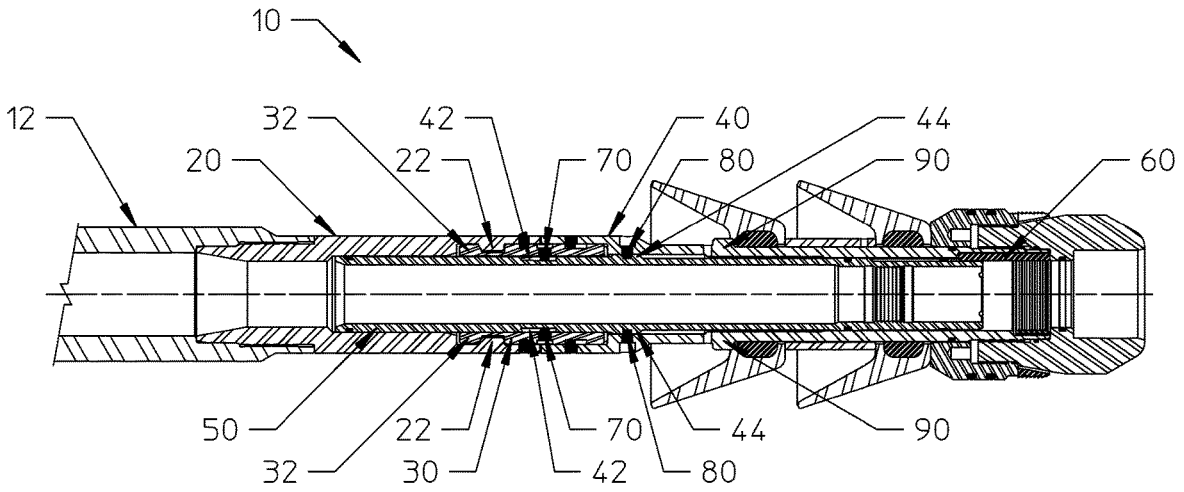
FIG. 1 is a longitudinal cross-sectional view of a liner wiper plug system before an actuation sleeve is shifted, in accordance with an embodiment of the present disclosure.

Turning now to FIG. 1, in some embodiments the liner wiper plug system 10 may include four major components: the release mandrel 20, the release sub 30, the liner wiper plug body 40, and the actuation sleeve 50. Some embodiments may also use a key 60 and shear screws 80.

The release mandrel 20 may be directly connected to the bottom of a running tool 12 or may be an integral part of the running tool 12. Release mandrel 20 may have at least one slotted inner-circumferential load shoulder 22. The release sub 30 may contain at least one slotted outer-circumferential load shoulder 32 that may interact with at least one inner-circumferential load shoulder 22 of release mandrel 20. The slots of the at least one inner-circumferential load shoulder 22 of the release mandrel 20 may be larger than the outer-circumferential load shoulder segments 32 of the release sub 30. When running downhole, load shoulders 22 and 32 may be oriented such that axial load can be transmitted between release mandrel 20 and release sub 30.

The liner wiper plug body 40 may be the main mandrel of the liner wiper plug system 10 and may house any components required for the liner wiper plug system 10 to function properly, excluding components required for release operations. The liner wiper plug body 40 may be clutched to the release mandrel 20 to prevent relative rotation between the two parts. The embodiment in FIG. 1 may use a jaw clutch to prevent such relative motion (shown in FIG. 2C). However, as a person of ordinary skill in the art would appreciate, other embodiments may use splined bodies, a keyed system, or a shear screw/slot system to prevent relative rotation between the two parts. The liner wiper plug body 40 may be connected to the release sub 30 in a manner which prevents axial motion between the parts but allows for relative rotation. The embodiment in FIG. 1 may use shear screws 80 in a groove to prevent such axial motion. However, as a person of ordinary skill in the art would appreciate, other embodiments may use a snap ring, lugs, or a simple load shoulder to prevent axial motion.

The actuation sleeve 50 may interact with the release sub 30 and the liner wiper plug body 40. The principal feature of the actuation sleeve 50 may be a helical slotted guide 42, as will be described in detail below. In the embodiment in FIG. 1, the helical slotted guide 42 may provide the main source of interaction with the guide pins 70 on release sub 30. In embodiments, there may be ono or more helical slotted guides 42. The helical slotted guide 42 may be shaped such that, upon any axial motion by the actuation sleeve 50, the helical slotted guide 42 will apply forces to the guide pins 70 that in turn cause the release sub 30 to rotate. However, as a person of ordinary skill in the art would appreciate, other embodiments may use dowel pins or lugs or other suitable devices instead of guide pins for the interaction with the helical slotted guide.

The actuation sleeve 50 may be clutched to the liner wiper plug body 40 to prevent relative rotation between the two parts. In some embodiments, a key 60 may be used to activate the clutch. However, as a person of ordinary skill in the art would appreciate, other embodiments may consist of splined bodies or a shear screw/slot system to prevent relative rotation between the two parts.

The actuation sleeve 50 may contain at least one outer-circumferential load shoulder 44 which interacts with at least one inner-circumferential load shoulder 90 on the liner wiper plug body 40. As will be described in detail below, the load shoulders 44 and 90 dictate the maximum amount of relative axial motion that is allowed between actuation sleeve 50 and liner wiper plug body 40.

When running downhole, the liner wiper plug body 40 may be mechanically locked to the running tool 12 via the load shoulder 22 of release mandrel 20 and the load shoulder 32 of release sub 30. The liner wiper plug body 40 may not be released until the actuation sleeve 50 shifts, regardless of well conditions, pressure, or pump rate. In the embodiment shown in FIG. 1, premature shifting of the actuation sleeve 50 is prevented via shear screws 80 in the liner wiper plug body 40. However, as a person of ordinary skill in the art would appreciate, other embodiments may utilize shear tabs/rings or utilize the tail end of a leading liner wiper plug to prevent the actuation sleeve 50 from shifting prior to full release of the leading liner wiper plug.

Figure 2A:
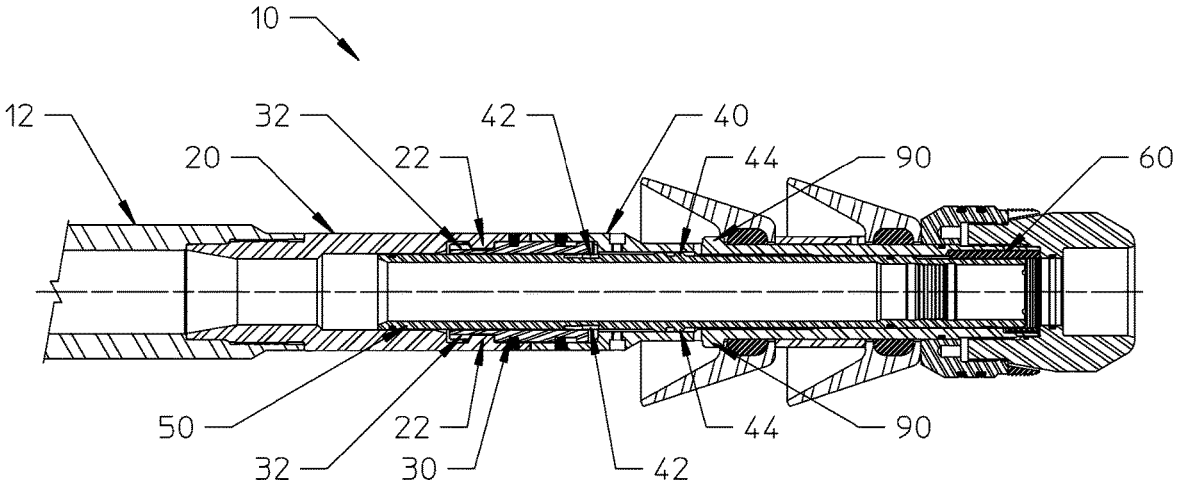
FIG. 2A is a longitudinal cross-sectional view of the liner wiper plug system, shown in FIG. 1, after the actuation sleeve is shifted, in accordance with an embodiment of the present disclosure.

Referring now to FIG. 2A, a cross-sectional view of an embodiment of the liner wiper plug system 10 is shown with the actuation sleeve 50 shifted downhole. When release of the liner wiper plug body 40 is desired, the actuation sleeve 50 may be shifted using a device such as a drill pipe cementing dart or a ball (not shown). The pressure build-up behind the dart or ball may cause actuation sleeve 50 to exert sufficient force to shear the shear screws 80 in FIG. 1, thereby allowing actuation sleeve 50 to stroke downhole in FIG. 2A.

As the actuation sleeve 50 shifts downhole, the guide pins (70 in FIG. 1) of the release sub 30 may ride along the helical slotted guide 42 in actuation sleeve 50, thereby causing release sub 30 to rotate relative to the release mandrel 20, liner wiper plug body 40, and the actuation sleeve 50. Although release sub 20 may rotate, actuation sleeve 50 may not rotate while stroking downhole because any torque may be transmitted through the key 60 to the liner wiper plug body 40 and to the release mandrel 20 via the jaw clutch (shown in FIG. 2C).

Figure 2B:
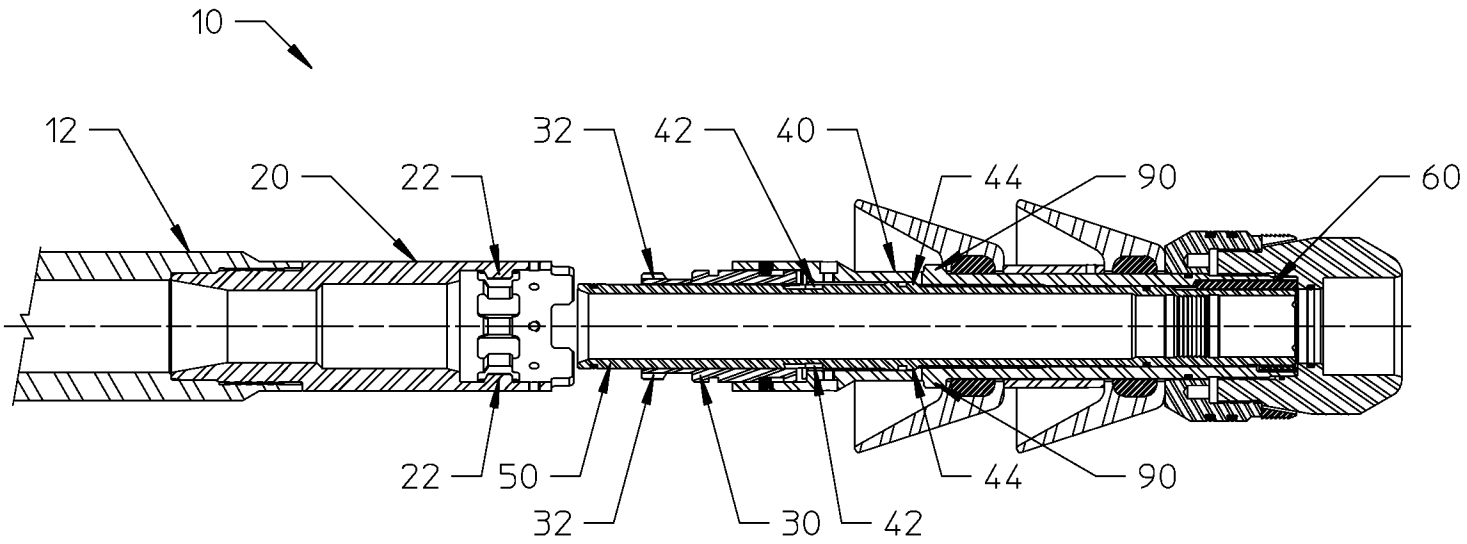
FIG. 2B is a longitudinal cross-sectional view of the liner wiper plug system, shown in FIG. 1, after the liner wiper plug detaches fully from the release mandrel, in accordance with an embodiment of the present disclosure.
Figure 2C:
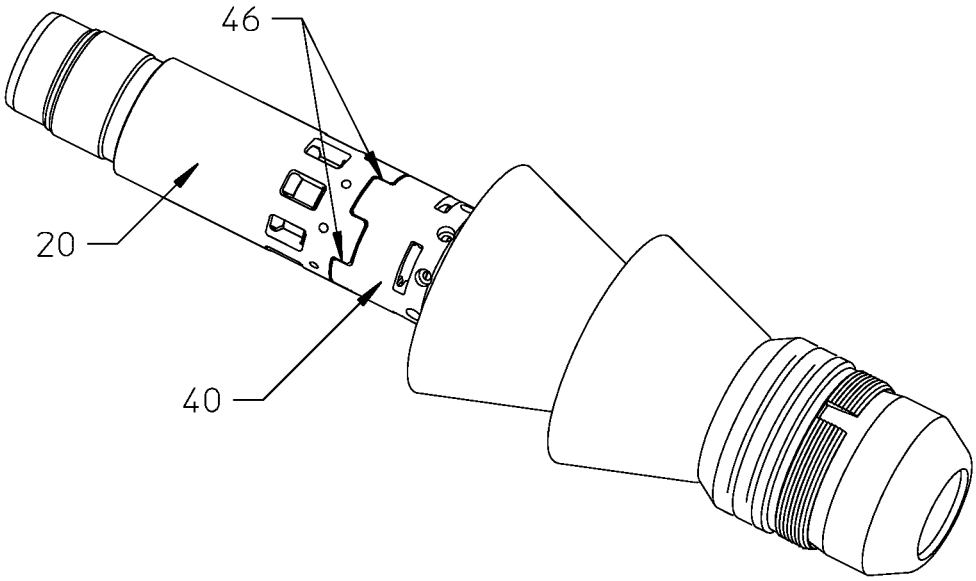
FIG. 2C is an outside view of a liner wiper plug system showing a jaw clutch, in accordance with an embodiment of the present disclosure.

The axial stroke downhole of the actuation sleeve 50 ends when at least one outer-circumferential load shoulder 44 of the actuation sleeve 50 contacts at least one inner-circumferential load shoulder 90 of the liner wiper plug body 40. As will be described in more detail below, at the completion of the axial stroke downhole of the actuation sleeve 50, release sub 30 may be angularly oriented such that load shoulders 32 of release sub 30 are aligned with slots (not shown) in between load shoulders 22 of release mandrel 20. When such unlocked orientation occurs and when the actuation sleeve load shoulder 44 contacts the liner wiper plug body's at least one inner-circumferential load shoulder 90, the axial pressure on the actuation sleeve 50 may transmit an axial load from actuation sleeve 50 to the liner wiper plug body 40, thereby detaching liner wiper plug body 40 from release mandrel 20 and launching liner wiper plug body 40 downhole. In summary, the orientation of release sub load shoulders 32 with slots of release mandrel shoulders 22 may allow the actuation sleeve to stroke downhole and cause the actuation sleeve load shoulders 44 to contact the liner wiper plug body load shoulders 90, thereby causing the liner wiper plug body 40 to detach from the release mandrel 20. FIG. 2B shows a cross-sectional view of an embodiment of the liner wiper plug system 10 with the liner wiper plug body 40 fully detached from release mandrel 20.

Figure 3:
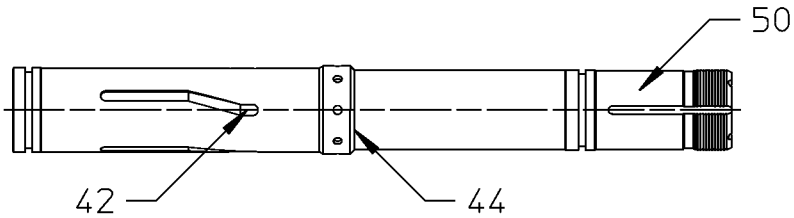
FIG. 3 is a longitudinal side view of an actuation sleeve separate from any liner wiper plug system, in accordance with an embodiment of the present disclosure.

FIG. 3 shows a side-view embodiment of actuation sleeve 50 that is shown removed from liner wiper plug system 10. In this embodiment, FIG. 3 shows a sigmoid-shaped helical guide 42 that may interact with guide pins 70 in release sub 30. As a person of ordinary skill in the art would appreciate, helical guide 42 may be of any shape that will translate the axial motion of actuation sleeve 50 into rotational motion of release sub 30. Also shown in this embodiment is the actuation sleeve load shoulder 44 that may cause the ejection of the liner wiper plug body 40 upon the proper orientation of load shoulders 22 and 32 of release mandrel 20 and release sub 30, respectively.

Figure 4:
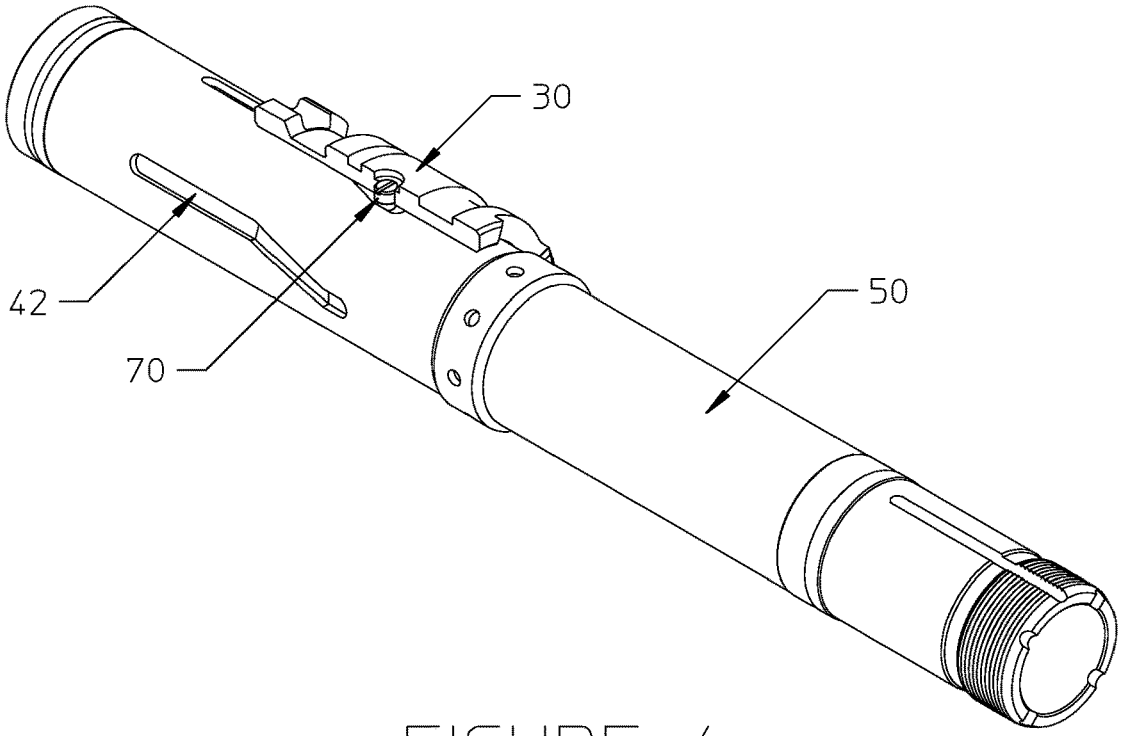
FIG. 4 is an enlarged side elevational view of a release sub and actuation sleeve before the actuation sleeve is shifted, in accordance with an embodiment of the present disclosure.
Figure 5:
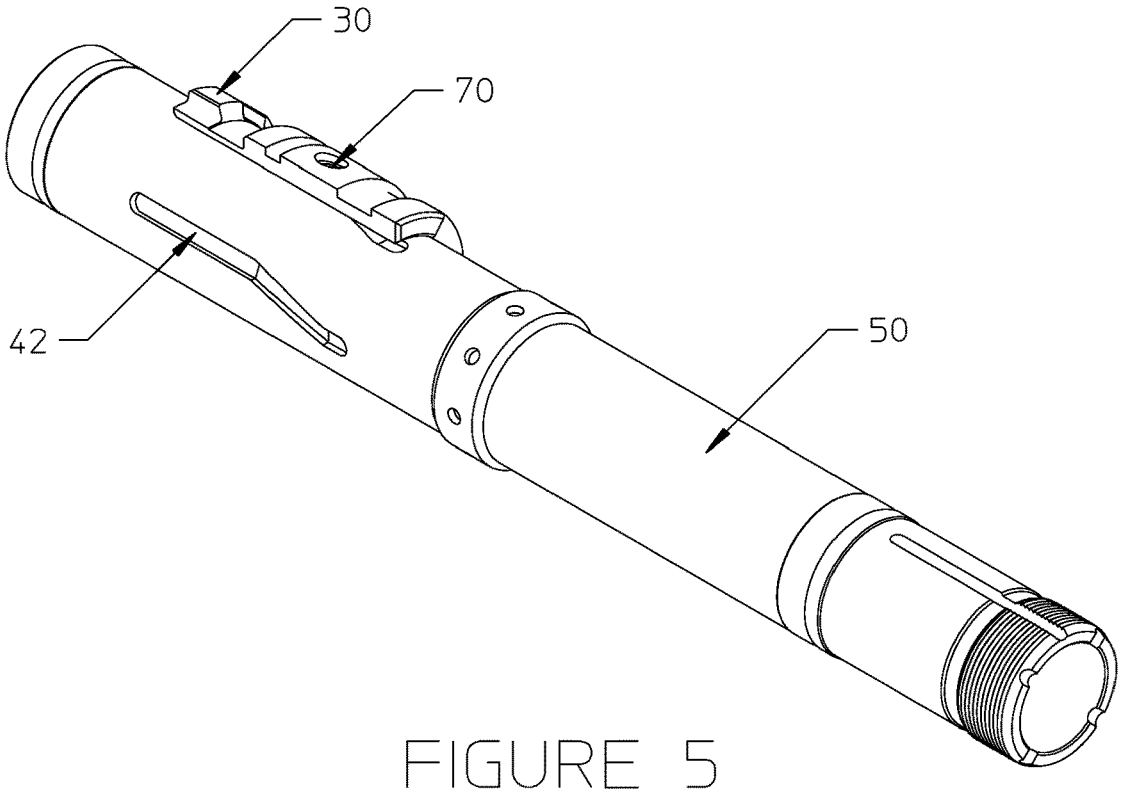
FIG. 5 is an enlarged side elevational view of the release sub and actuation sleeve, shown in FIG. 1, after the actuation sleeve is shifted, in accordance with an embodiment of the present disclosure.

FIGS. 4 and 5 show the interaction between the release sub 30 and the actuation sleeve 50 before and after actuation respectively. FIG. 4 shows how, before actuation, guide pin 70 may be at the bottom end of helical guide 42, thereby placing release sub 30 near the bottom end of helical guide 42. FIG. 5 shows how, after actuation, guide pin 70 may be at the top end of helical guide 42, thereby rotating release sub 30 and placing it near the top end of helical guide 42. FIGS. 4 and 5, when viewed together, show how release sub 30 may rotate due to the shape of helical guide 42 in actuation sleeve 50. As a person of ordinary skill in the art would appreciate, helical guide 42 may be of any shape that will translate the axial motion of actuation sleeve 50 into rotational motion of release sub 30.

Figure 6:
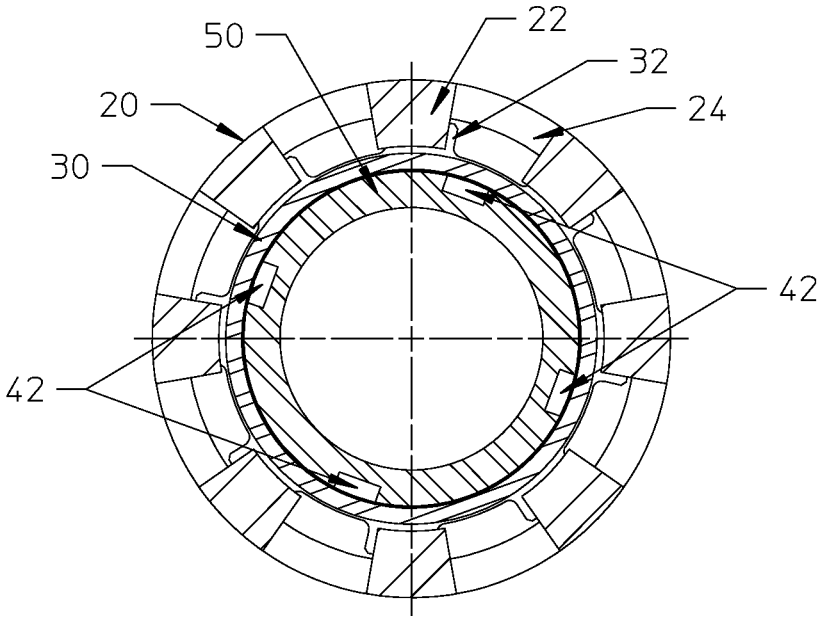
FIG. 6 is an up-hole, cross-sectional view of the interaction between a mandrel and release sub before the actuation sleeve is shifted, in accordance with an embodiment of the present disclosure.
Figure 7:
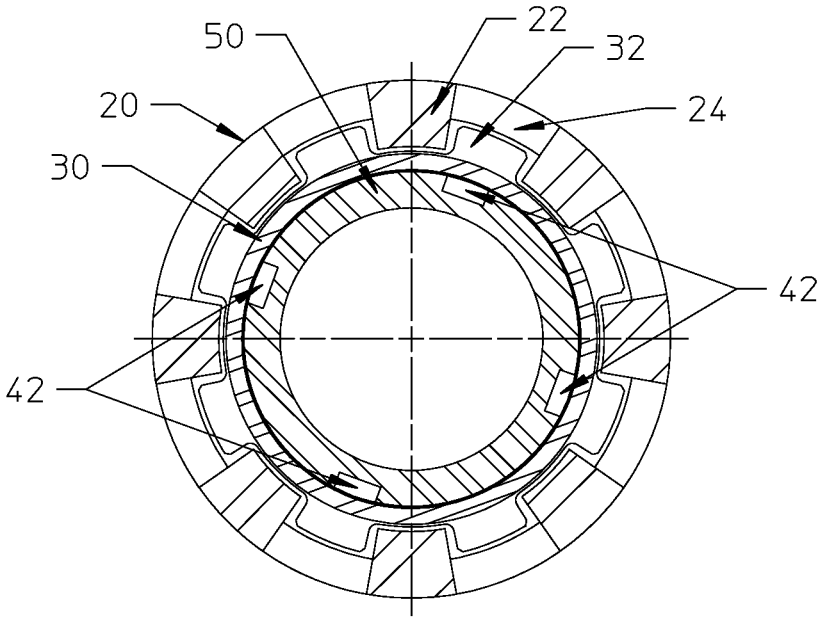
FIG. 7 is an up-hole, cross-sectional view of the interaction between the mandrel and release sub, shown in FIG. 6, after the actuation sleeve is shifted in accordance with an embodiment of the present disclosure.

FIGS. 6 and 7 show up-hole, cross-sectional views of an embodiment of the interaction between the load shoulders 22 and slots 24 of release mandrel 20, the load shoulders 32 of release sub 30, and actuation sleeve 50. The release sub 30 may contain at least one slotted outer-circumferential load shoulder 32 that may interact with at least one inner-circumferential load shoulder 22 of release mandrel 20. In the cross-sectional view provided by FIG. 6, release sub shoulders 32 appear mostly hidden behind the release mandrel shoulders 22. When running downhole, such orientation between load shoulders 22 and 32 may allow an axial load to be transmitted between release mandrel 20 and release sub 30.

At the completion of an axial stroke downhole of actuation sleeve 50, helical guide 42 may angularly orient release sub 30 such that the load shoulders 32 of release sub 30 are aligned with the slots 24 of release mandrel 20. In the cross-sectional view provided by FIG. 7, the shoulders 32 of release sub 30 are now visible because shoulders 32 are no longer hiding behind shoulders 22, but are instead located in slots 24. This orientation may allow for the liner wiper plug body 40 to unlock from the release mandrel 20 as explained above.

Figure 8:
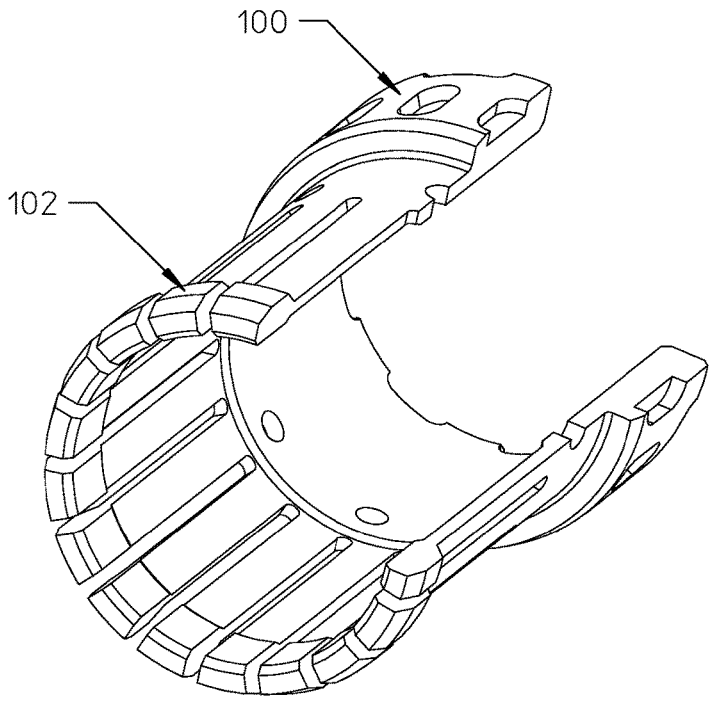
FIG. 8 is a partial cutaway outside view of a collected release sub and is shown removed from any liner wiper plug system, in accordance with an embodiment of the present disclosure.

FIG. 8 shows a close-up view of a collected release sub 100, which is an alternative to release sub 30, and is shown removed from any liner wiper plug system. Collected release sub 100 may include at least a load collet 102 that is capable of retracting into a circumference that is smaller than its initial circumference.

Figure 9:
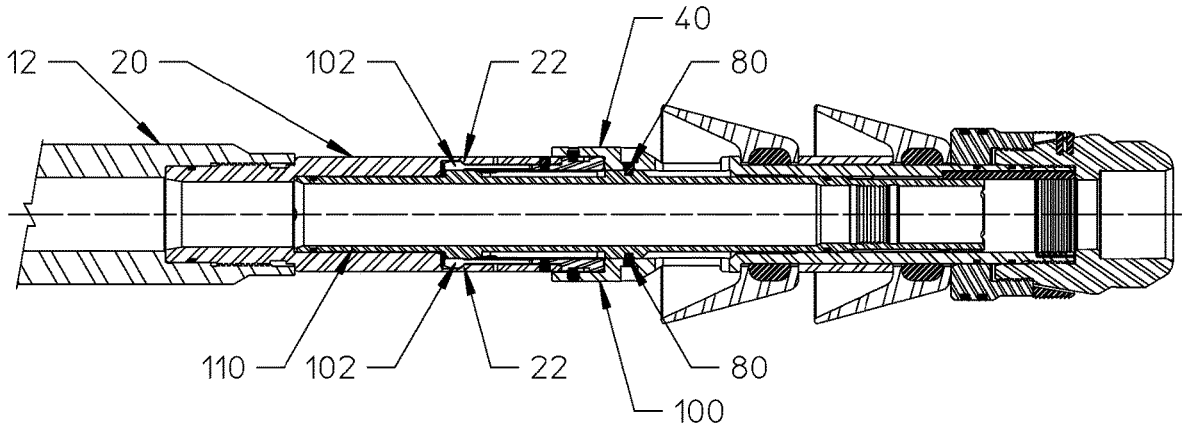
FIG. 9 is a longitudinal cross-sectional view of a liner wiper plug system before an actuation sleeve is shifted, in accordance with an embodiment of the present disclosure.

FIG. 9 shows, like load shoulder 32 on release sub 30, collected release sub 100 may contain at least one slotted outer-circumferential load collet 102 that may interact with the at least one inner-circumferential load shoulder 22 of release mandrel 20. The slots of the at least one inner-circumferential load shoulder 22 of the release mandrel 20 may be larger than the outer circumferential load collet 102 of the collected release sub 100. When running downhole, load shoulders 22 and 102 may be oriented such that axial load can be transmitted between release mandrel 20 and collected release sub 100. Therefore, when running downhole, the liner wiper plug body 40 may be mechanically locked to the running tool 12 via the load shoulder 22 of release mandrel 20 and the load shoulder 102 of release sub 100.

The liner wiper plug body 40 may be connected to the collected release sub 100 in a manner which prevents axial motion between the parts but allows for relative rotation. The embodiment in FIG. 9 uses shear screws 80 in a groove to prevent such axial motion. However, as a person of ordinary skill in the art would appreciate, other embodiments may use a snap ring, lugs, or a simple load shoulder to prevent axial motion.

Figure 10:
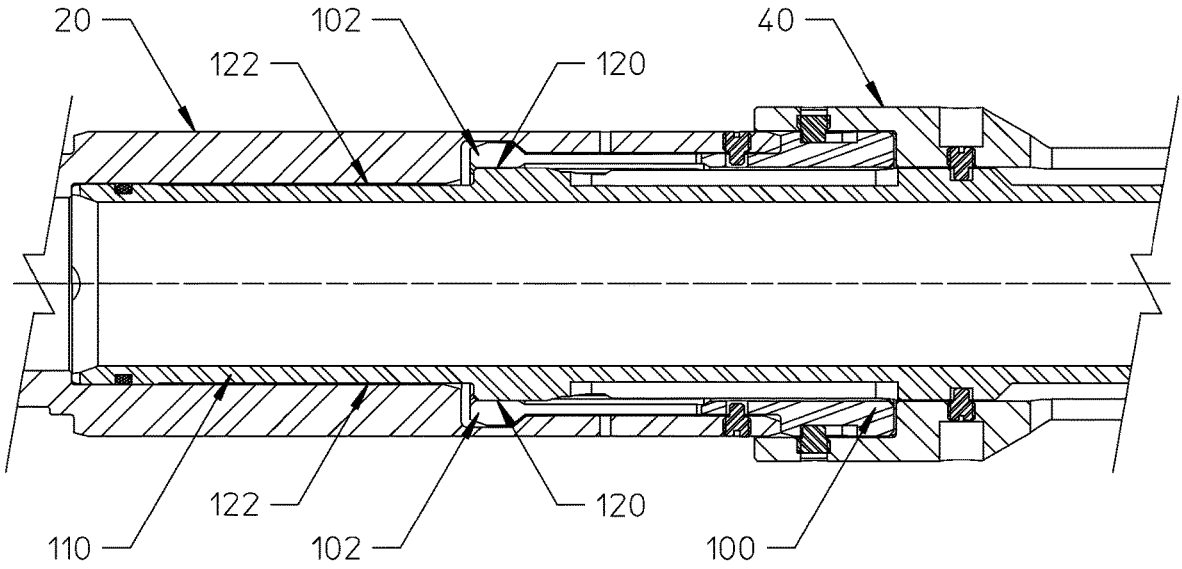
FIG. 10 is a close-up view of a longitudinal cross-sectional view of a liner wiper plug system, shown in FIG. 9, before an actuation sleeve is shifted, in accordance with an embodiment of the present disclosure.
Figure 11:
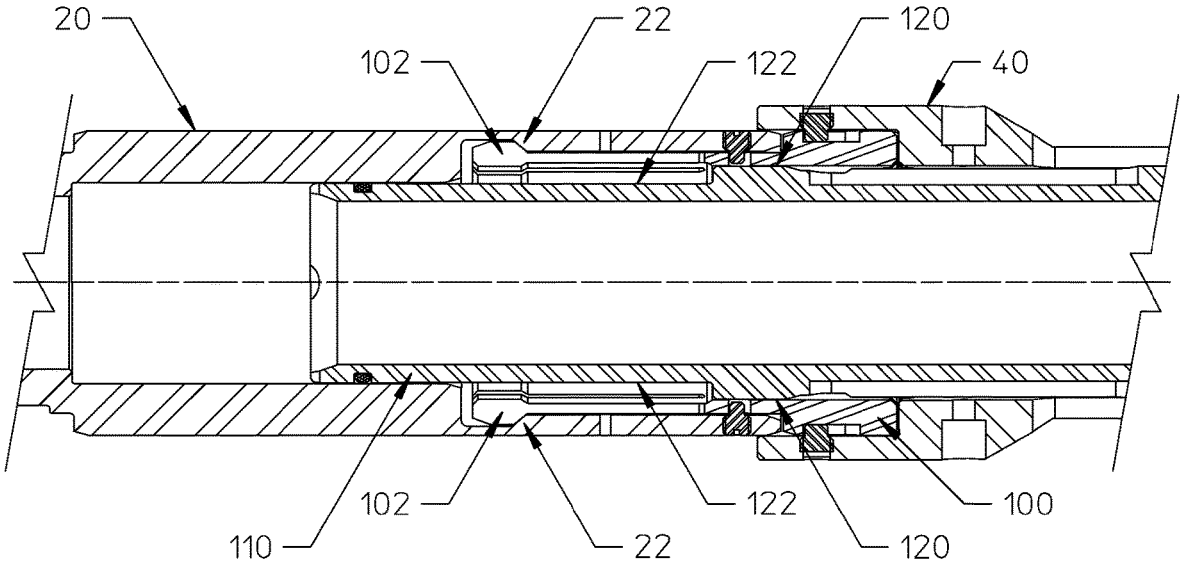
FIG. 11 is a close-up view of a longitudinal cross-sectional view of the liner wiper plug system, shown in FIG. 9, after the actuation sleeve is shifted, in accordance with an embodiment of the present disclosure.

The actuation sleeve 110 may interact with the collected release sub 100 and the liner wiper plug body 40. As shown in FIG. 10, the principal feature of the actuation sleeve 110 may be a raised outer diameter surface 120 adjacent to a lowered outer diameter surface 122. Both surfaces 120 and 122 may, separately, interact with load collet 102 when actuation sleeve 110 is disposed in different orientations. FIG. 10 shows an embodiment where the actuation sleeve 110 is in a locked position, where the raised outer diameter surface 120 may be in contact with load collet 102. FIG. 11 shows an embodiment where the actuation sleeve 110 is disposed in a different axial orientation than in FIG. 10, whereby load collet 102 may contract and may be in contact (not shown) with lowered outer diameter surface 122. In some embodiments, load collet 102 may contract under its own force. In some embodiments, load collet 102 may contract by the force of load shoulders 22 against load collet 102. Load shoulders 22 may exert a force against load collet 102 in the event that a device such as a drill pipe cementing dart or a ball (not shown) lands on the actuation sleeve 110, forcing the liner wiper body to pull release sub 100 out of release mandrel 20.

Figure 12:
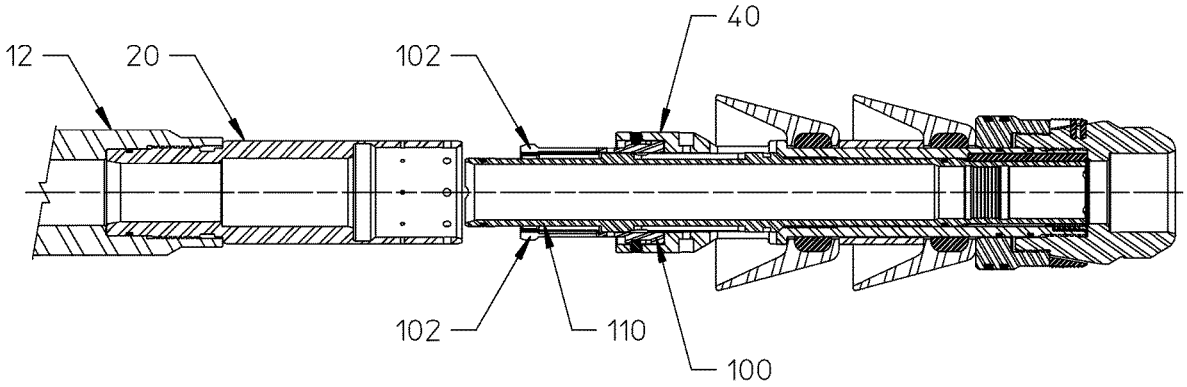
FIG. 12 is a longitudinal cross-sectional view of the liner wiper plug system, shown in FIG. 9, after the liner wiper plug detaches fully from the release mandrel, in accordance with an embodiment of the present disclosure.

FIG. 12 shows a cross-sectional view of an embodiment of the system described in FIGS. 9-11 with the liner wiper plug body 40 fully detached from release mandrel 20. As shown in FIG. 12, collected release sub 100 is entirely attached to liner wiper plug body 40. The collet 102 may be machined directly into the wiper plug body 40 such that the wiper plug body 40 and the load collet 102 are the same piece. In the illustrated embodiment, however, the collet 102 is a separate component attached directly to the wiper plug body 40.

Although the present disclosure and its advantages have been described in detail, it should be understood that various changes, substitutions and alterations can be made herein without departing from the spirit and scope of the disclosure as defined by the following claims.

What is claimed is:

1. A liner wiper plug system comprising:
a liner wiper plug body; and
a release mechanism detachably coupled to the liner wiper plug body, the release mechanism comprising:
a mandrel having an inner circumferential surface with at least one load-bearing shoulder formed thereon;
an actuation sleeve disposed within the mandrel, the actuation sleeve having an outer circumferential surface with a helical slot formed therein; and
a release sub having a first end disposed within the mandrel and a second end disposed within the liner wiper plug body,
the release sub further having an inner circumferential surface with a pin formed thereon, which is adapted to be disposed within and move along the helical slot of the actuation sleeve, thereby causing the release sub to rotate relative to the mandrel when the actuation sleeve moves in an axial motion, and
the release sub further having an outer circumferential surface with at least one load-bearing shoulder formed thereon, which is adapted to engage the at least one load-bearing shoulder formed on the mandrel.

2. The system as defined in claim 1 wherein:
said actuation sleeve has an outer circumferential load shoulder;
said liner wiper plug body has an inner circumferential load shoulder; and
at the completion of said axial motion, the outer circumferential load shoulder of the actuation sleeve contacts the inner circumferential load shoulder of the liner wiper plug body, thereby detaching the liner wiper plug body by transmitting any axial load due to the actuation sleeve's axial motion from the actuation sleeve to the liner wiper plug body.

3. The system as defined in claim 1 wherein:
said helical slot is formed such that an axial motion of said actuation sleeve causes said rotation of said release sub.

4. The system as defined in claim 3 wherein:
said mandrel is attached to a downhole running tool; and
said actuation sleeve further comprises a seat operable to receive a drill pipe cementing dart or ball.

5. The system as defined in claim 4 wherein:
said liner wiper plug body further comprises shear screws, shear tabs, or shear rings operable to prevent said axial motion by said actuation sleeve until sheared.

6. The system as defined in claim 1 wherein:
said inner circumferential surface of said mandrel has a plurality of slotted load-bearing shoulders formed equidistant thereon; and
said outer circumferential surface of said release sub has a corresponding plurality of complementary slotted load-bearing shoulders formed thereon, which are adapted to engage the plurality of slotted load-bearing shoulders formed on said mandrel.

7. The system as defined in claim 6 wherein:
at the completion of said rotation of said release sub, said slotted load-bearing shoulders on said release sub are aligned with the slots in the slotted load-bearing shoulders of said mandrel, thereby allowing the release sub to detach from the mandrel.

8. The system as defined in claim 1 wherein:
said outer circumferential surface of said actuation sleeve has one or more helical slotted guides formed therein; and
said inner circumferential surface of said release sub has a corresponding plurality of pins formed thereon, which are adapted to be disposed within and move along the one or more helical slotted guides of the actuation sleeve thereby causing the release sub to rotate relative to the mandrel.

9. The system as defined in claim 8 wherein:
said pins on said release sub are shear screws, dowel pins, or lugs.

10. A method of detaching a downhole liner wiper plug from a liner wiper plug body comprising:
lowering a liner wiper plug system into a wellbore or section of downhole tubing, the liner wiper plug system comprising the liner wiper plug body, a mandrel, an actuation sleeve, and a release sub,
wherein said mandrel has an inner circumferential surface with a plurality of slotted load-bearing shoulders formed equidistant thereon,
wherein said actuation sleeve is disposed within the mandrel,
wherein said release sub has a first end disposed within the mandrel and a second end disposed within the liner wiper plug body;
wherein said release sub has an outer circumferential surface with a corresponding plurality of complementary slotted load-bearing shoulders formed thereon, which are adapted to engage the plurality of slotted load-bearing shoulders formed on said mandrel; and
moving said actuation sleeve in an axial direction, wherein the axial motion causes the release sub to rotate with respect to said mandrel.

11. The method of claim 10:
wherein at the completion of said rotation, said slotted load-bearing shoulders on said release sub align with the slots in the slotted load-bearing shoulders of said mandrel, thereby allowing the release sub to detach from the mandrel.

12. The method of claim 11:
wherein said actuation sleeve has an outer circumferential load shoulder;
said liner wiper plug body has an inner circumferential load shoulder; and
at the completion of said axial motion, the outer circumferential load shoulder contacts the inner circumferential load shoulder, thereby detaching the liner wiper plug body by transmitting any axial load due to the actuation sleeve's axial motion from the actuation sleeve to the liner wiper plug body.

13. The method of claim 10:

wherein said release sub has at least one slotted outer-circumferential load collet which is adapted to engage the at least one of the plurality of load-bearing shoulders formed on the mandrel.

14. The method of claim 13:

wherein the actuation sleeve further comprises a raised outer diameter surface adjacent to a lowered outer diameter surface, wherein the raised outer diameter surface is in contact with the at least one slotted outer-circumferential load collet in a locked position; and at the completion of said axial motion, the at least one slotted outer-circumferential load collet contracts and contacts the lowered outer diameter surface, thereby releasing the release sub and detaching the liner wiper plug body from the mandrel.

15. The method of claim 10:

wherein said mandrel is attached to a downhole running tool.

16. The method of claim 10:

wherein said axial motion is caused by a drill pipe cementing dart or ball that lands on a seat formed within the actuation sleeve which in turn blocks the flow of fluid downhole thereby generating a downward acting pressure force, which is applied to the actuation sleeve.

* * * * *